US005979405A

United States Patent [19]

Sato et al.

[11] Patent Number: 5,979,405

[45] Date of Patent: Nov. 9, 1999

[54] APPARATUS FOR CONTROLLING A THROTTLE VALVE ELECTRONICALLY IN AN INTERNAL COMBUSTION ENGINE

[75] Inventors: Hisaaki Sato; Ikuo Mogi, both of Gunma; Masato Kumagai, Saitama; Munehiro Kudo; Keiichi Kai, both of Gunma, all of Japan

[73] Assignee: Unisia Jecs Corporation, Atugi, Japan

[21] Appl. No.: 09/035,069

[22] Filed: Mar. 5, 1998

[30] Foreign Application Priority Data

Mar. 13, 1997 [JP] Japan ..... 9-058662

[51] Int. Cl.[6] ..... F02D 7/00

[52] U.S. Cl. ..... 123/399

[58] Field of Search ..... 123/399, 361, 123/400

[56] References Cited

U.S. PATENT DOCUMENTS

| | | | |
|---|---|---|---|
| 4,809,659 | 3/1989 | Tamaki et al. | 123/399 |
| 5,350,034 | 9/1994 | Sato | 180/197 |
| 5,423,299 | 6/1995 | Kumagai | 123/399 |
| 5,431,141 | 7/1995 | Kanazawa et al. | 123/399 |
| 5,467,751 | 11/1995 | Kumagai | 123/399 |
| 5,490,487 | 2/1996 | Kato et al | 123/399 |
| 5,738,072 | 4/1998 | Bolte et al. | 123/399 |
| 5,868,114 | 2/1999 | Kaminmura et al. | 123/399 |

FOREIGN PATENT DOCUMENTS

| | | |
|---|---|---|
| 0723072 A1 | 1/1996 | European Pat. Off. . |
| 6-63460 | 8/1994 | Japan . |

*Primary Examiner*—Thomas N. Moulis
*Attorney, Agent, or Firm*—Foley & Lardner

[57] ABSTRACT

An apparatus for controlling a throttle valve electronically in an internal combustion engine. The actuator 2 is supported on a body 1A by fixing a base plate 7 to a flange 1B of the body 1A with a bolt 6, and an elastic member 9 is fixed at an outer surface of a cylindrical projection 2C which is positioned on one end 2B of the body of the actuator 2. The inner surface of a case 1C of the body 1A covers cylindrical projection 2C. One end 2B of the body of the actuator 2, opposite the actuator output end, is thus supported by the body 1A via elastic member 9. Therefore, it is not necessary to provide a heavy wall thickness of the flange by which the actuator 2 is supported or of the body of the actuator, and increase the strength of the internal structure of the actuator, and increase weight, size, and cost of the actuator.

12 Claims, 4 Drawing Sheets

APPARATUS FOR CONTROLLING A THROTTLE VALVE ELECTRONICALLY IN AN INTERNAL COMBUSTION ENGINE

BACKGROUND OF THE INVENTION

1. Field of The Invention

The present invention relates to improvements to an apparatus for controlling a throttle valve electronically, such as an electronic motor, in an internal combustion engine.

2. Description of The Background Art

The previously known apparatus 1, as shown in FIG. 6, is installed in an intake air passage of an internal combustion engine, and the actuator 2 (such as an electronic motor) generates driving power on the basis of a driving signal of the control unit, which can open/close the throttle valve through the gear wheel transfer structure 3 and the axis 4 and related structure. The actuator can make an adjustment to the open angle of the throttle valve, which is separated from the accelerator operation of the driver. However, the actuator 2 is fixed on the flange 1B of the body 1A with a bolt 6. Thus, a one end supporting structure is used, which has the defects discussed below.

A one end supporting structure does not have enough anti-vibration control, and the actuator 2 is vibrated easily by the contrary rotation power on one end 2A side, which is the starting point. This problem could be reduced by making a heavy wall thickness of the flange and the body of the actuator 2, or increasing the strength of the internal structure of the actuator 2. However, this increases the weight, the size, and the cost.

Furthermore, the anti-vibration characteristics may be improved by fixing the free end 2B side of the actuator 2 (non-output side) on the case 1C of the body 1A with a press fit. But in this case, high accuracy may be needed to maintain the precision position to the gear wheel transfer structure 3. As a result, this may make assembly more difficult and increase the cost by a large amount.

SUMMARY OF THE INVENTION

It is, therefore, an object of the present invention to provide an apparatus for controlling a throttle valve electronically in an internal combustion engine which addresses the above situation by improving the anti-vibration characteristics, while reducing the cost and providing a simple structure.

In view of the above, an apparatus for controlling a throttle valve electronically according to the present invention comprises a throttle valve installed in an intake air passage of an internal combustion engine, and an actuator to control the throttle valve to open/close, and a supporting member to fasten a body of the actuator on the output side of the actuator, and a cover member to cover the body of the actuator, which has a predetermined gap to the cover member, and which is supported independently from open/close control of the throttle valve on the non-output side of the actuator, and an elastic member in the predetermined gap.

With such a structure for the present invention, the non-output side of the body is supported by the elastic member, and both ends are supported instead of one end, and the anti-vibration characteristics can be improved effectively even though a simple and low cost structure is used.

That is to say, it is not necessary to make a heavy wall thickness of the flange by which the actuator 2 is supported or of the body of the actuator, and increase the strength of the internal structure of the actuator, and increase the weight, the size, and the cost of the actuator.

Furthermore, the actuator can be fixed flexibility on, and there is no need to require high precision work for precision positioning, which can make assembly more difficult and increase the cost.

In addition, the elastic member is placed in the predetermined gap which is formed between the cylindrical outer side of the actuator which is covered by the cover member on the non-output side and the inside of the cover member, or the elastic member is placed in the predetermined gap which is formed between the plane perpendicular to the output axis of the actuator and the inside of the cover member.

Also, the present invention further comprises fixing means to fix the elastic member in the predetermined gap which is formed between the cylindrical outer side of the actuator, which is covered by the cover member on the non-output side, and the inside of the cover member, and as a result, the fixing means restricts the movement of the elastic member along the cylindrical central axis of the non-output side of the actuator.

DETAILED DESCRIPTION OF THE PREFERRED EMBODIMENTS

Figure 6:
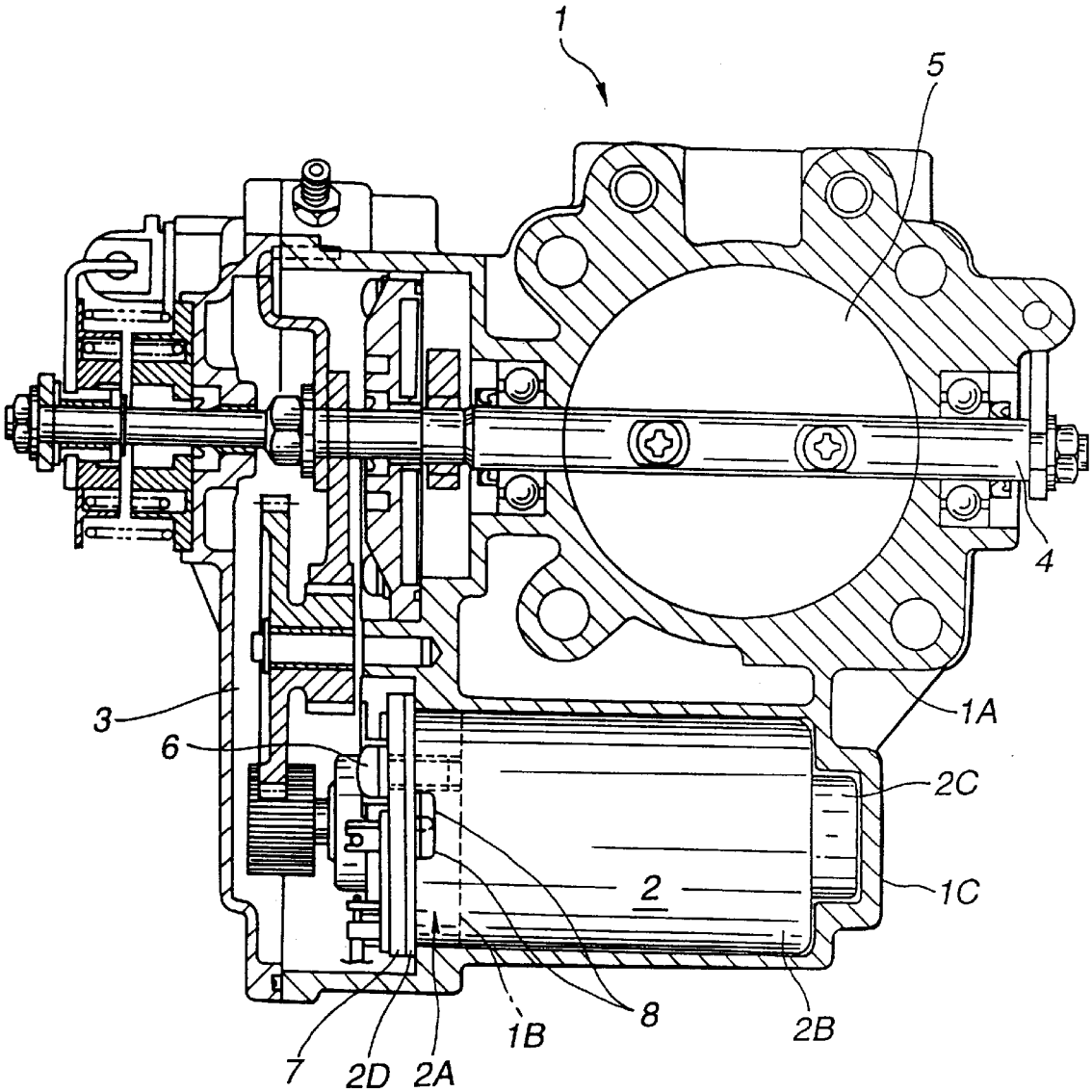
FIG.6 PRIOR ART
FIG. 6 is a section view of an apparatus for controlling a throttle valve electronically according to the previously known apparatus.

A more detailed description of the present invention is given below on the basis of attached figures which are provided with the same numbers for the same elements as shown in FIG. 6.

Figure 1:
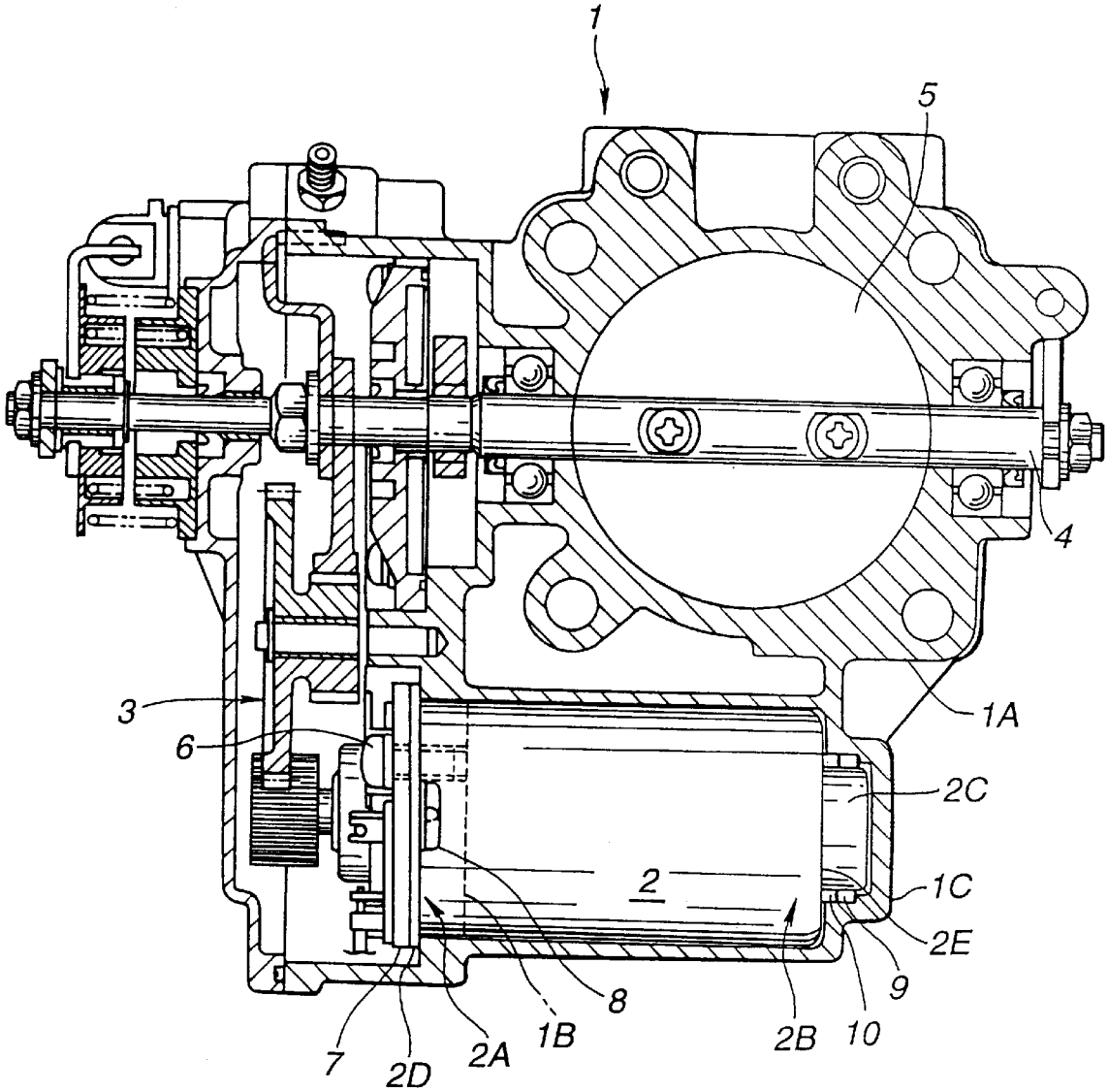
FIG. 1 is a section view of an apparatus for controlling a throttle valve electronically according to the first embodiment of the present invention.

The first embodiment associated with the present invention is shown in FIG. 1, which indicates the throttle valve 5 installed in an intake air passage of an internal combustion engine, and the intake air passage area can be adjusted by the throttle valve 5, which opens/closes around the rotation axis 4. The actuator 2, such as an electronic motor, generates driving power on the basis of a driving signal of the control unit (not shown), which can make an adjustment to the open angle of the throttle valve, which is separated from the accelerator operation of the driver.

The actuator 2 associated with the first embodiment is fixed via the flange 2D of the body of the actuator 2 to the base plate 7 with a bolt 8, and the actuator 2 and base plate 7 are fixed on the body 1A by fixing the base plate 7 to the flange 1B of the main body 1 with the bolt 6. The bolt 6, the base plate 7, and the bolt 8 form a supporting member.

However, if the actuator 2 is fixed to the body 1A on only one end 2A side (output side) of the actuator 2, the anti-vibration characteristics will deteriorate at one end. But in the first embodiment, the actuator is not only fixed to the body 1A on one end 2A side (output side), but also on the other end 2B side (non-output side). As a result, anti-vibration characteristics are improved. An elastic member 9 (an o-ring made of rubber, silicon, and so on) is fixed between the outer surface of the cylindrical projection 2C which is positioned on one end 2B side of the body of the actuator 2 and the inner surface of the case, or cover, 1C of the body 1A in which the cylindrical projection 2C is covered, and therefore, the end 2B side of the body of the actuator 2 is supported by the body 1A. In this way, a supporting structure which supports both ends is provided instead of a structure supporting one end. The structure by the end 2B side of the body of the actuator 2 is supported on the body 1A with the o-ring, and the anti-vibration characteristic is improved effectively even though a simple and a low cost structure is provided. That is to say, it is not necessary to make a heavy wall thickness of the flange by which the actuator 2 is supported or of the body of the actuator, and increase the strength of the internal structure of the actuator, and increase the weight, the size, and the cost of the actuator.

Furthermore, the actuator can be fixed flexibility on the case 1C of the body 1A with the o-ring, which does not require high precision work for precision fit and precision positioning to the gear wheel transfer structure 3. This makes assembly easier and reduces cost.

In the preferred embodiment, the o-ring for the elastic member is a standard o-ring, which is preferable from the view point of lower cost. In addition, a backup-ring 10 (the ring member consists of metal, plastic, gum, silicon and so on) which is positioned between the elastic member 9 and one end 2E of the body of the actuator 2, has the function of fixing the member 9 and preventing torsion and other movement of the elastic member 9 as shown in FIG. 1, and is preferable from the view point of cost. Furthermore, the outer surface of the projection 2C of the body of the actuator 2 can be in the shape of a step and have the same function and effect as the back-up-ring 10 as shown in FIG. 1. Also, the inner surface of the case 1C of the body 1A can have a flute in which the elastic member 9 is supported, and have the same function and effect as the back-up-ring 10 as shown in FIG. 1.

Figure 2:
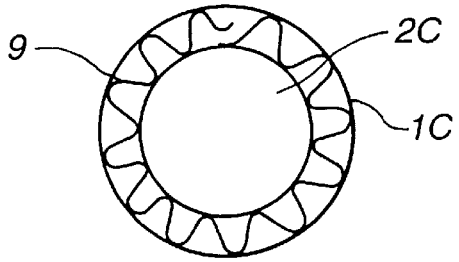
FIG. 2 is a part side view of using another elastic member.

The elastic member 9 can also be an elastic member of wave shape (metal, plastic, gum, silicon and so on) as shown in FIG. 2.

Although the first embodiment has the elastic member 9 fixed on the outer surface of the projection 2C of the body of the actuator 2, the invention is not limited to the above-mentioned structure. If supporting structure is provided at both ends instead of at one end by other means, for example, the elastic member 9 is fixed on the outer surface of the body of the actuator 2 other than the projection 2C, a similar result will be obtained.

Figure 3A:
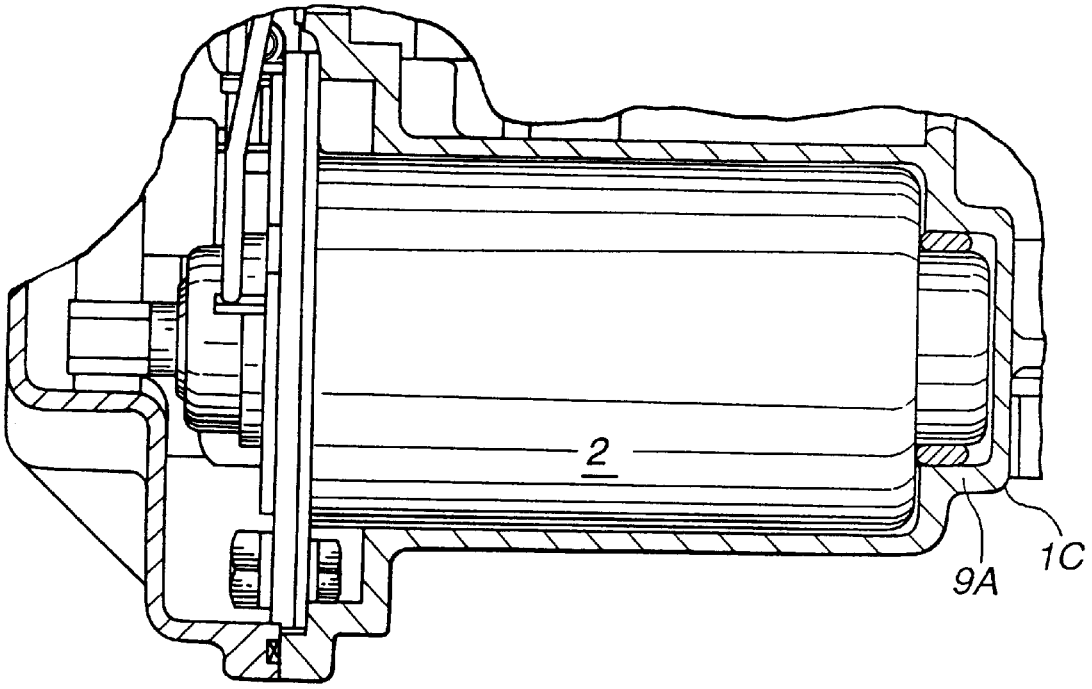
FIG. 3(A) is a part of another elastic member magnified.
Figure 3B:
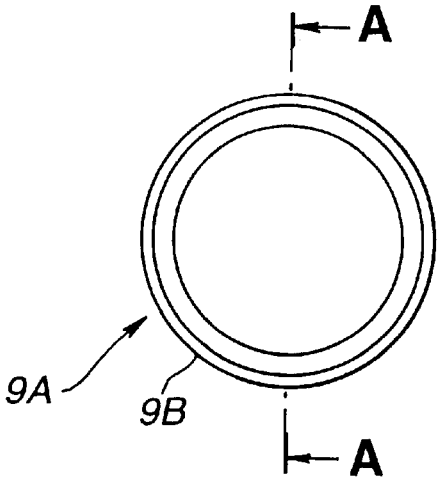
FIG. 3(B) is a front view of the elastic member shown FIG. 3(A).
Figure 3C:
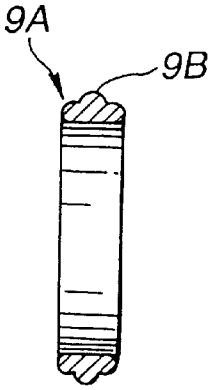
FIG. 3(C) is an III(C)—III(C) section view of FIG. 3(B).

In the above first embodiment, it is preferable to have the back-up-ring 10 positioned between the elastic member 9 and one end 2E of the body of the actuator 2, for ease of assembly and to prevent the torsion and other movement of the elastic member 9 as shown FIG. 1. Alternatively, o-ring 9A, which has a cross-sectional flat shape and a projection 9B in the direction of the outer surface for keeping the strength of supporting the actuator 2, as shown in FIGS. 3(A) to 3(C) can be provided. If the o-ring 9A is used, it is capable of adequately supporting the actuator, allows easy assembly, and prevents the torsion of the elastic member.

Next is a description of a second embodiment of the present invention. The above first embodiment employs the elastic member 9 fixed on the outer surface of the projection 2C of the body of the actuator 2, which is supported at both ends by supporting structure to improve the anti-vibration characteristics. The second embodiment can also improve the anti-vibration characteristics, as discussed below.

A more detailed description of the second embodiment is provided with same numbers for the same elements as shown in FIG. 6 or FIG. 1 associated with the first is embodiment.

Figure 4:
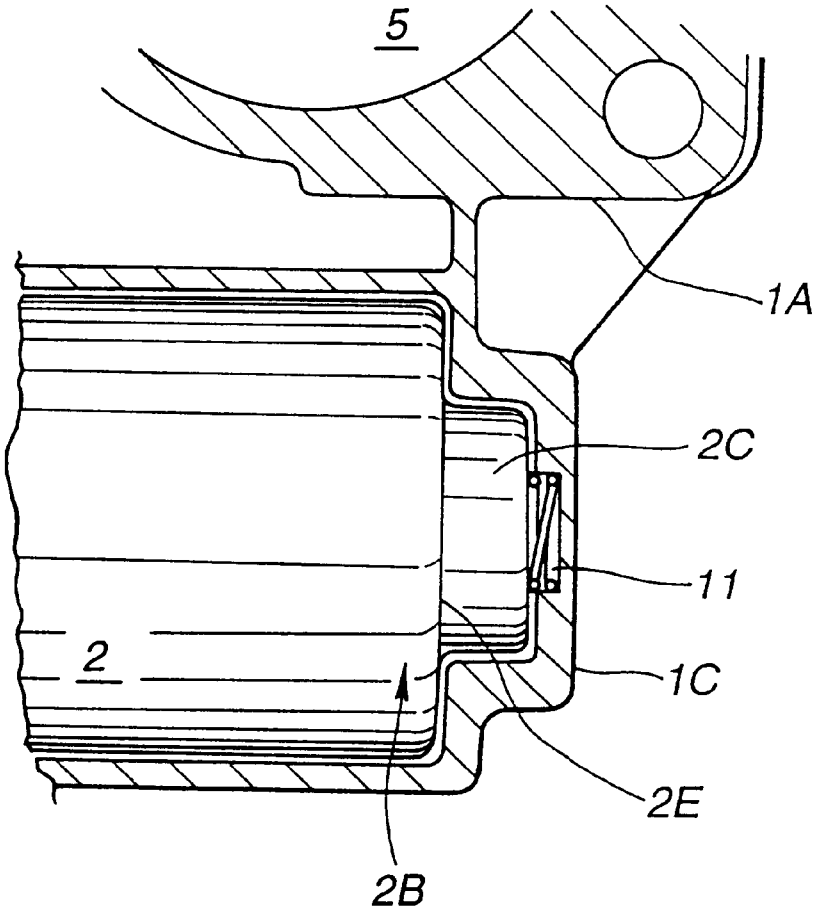
FIG. 4 is a part of the second embodiment of the present invention magnified.

The elastic member 11 (for example, a coil shaped spring) is fixed between one end of the projection 2C of the body of the actuator 2 and the inner surface of the case of the body 1A, as shown in FIG. 4. In addition, a part of the elastic member 11 is fitted into a depression, which fixes member 11. Therefore, the movement (vibration) of the end 2B of the body of the actuator 2 is prevented by the strength of supporting the actuator 2 on one end of the projection 2C using the elastic member 11 which produces friction between the elastic member 11 and the end of the projection 2C. This improves anti-vibration characteristics effectively even though the structure is simple and inexpensive. That is to say, it is not necessary to make a heavy wall thickness of the flange by which the actuator 2 is supported or of the body of the actuator, and increase the strength of the internal structure of the actuator, and increase the weight, the size, and the cost of the actuator. Furthermore, the end 2B side of the actuator can be fixed flexibility on the case 1C of the body 1A, which eliminates high precision work for precision fit and precision positioning to the gear wheel transfer structure 3. This makes assembly easier and reduces cost.

Figure 5:
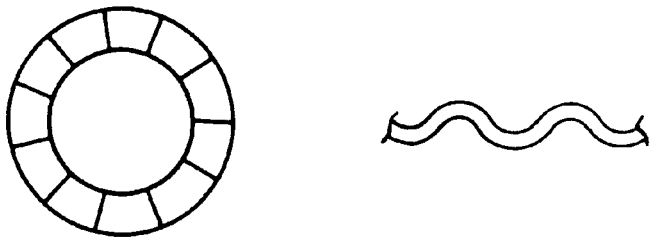
FIGS. 5 are views of another elastic member.

The elastic member 11 can also be an elastic member of a solid or hollow-body shape or bow shape (gum, silicon and so on) instead of the coil shaped and an elastic member of a ring shape (gum, silicon and so on). Furthermore, a wave-washer as shown in the FIG. 5(A) end view and FIG. 5(B) sectional view can be employed instead of the elastic member of the coil shaped as shown in FIG. 4. In addition, the invention can use both the elastic member 9 of the first embodiment and the elastic member 11 of the second embodiment, which can further improve the anti-vibration characteristics effectively, and the present invention can also be adaptable to a structure which does not have the projection 2C.

Furthermore, the present invention can also be adapted to a case 1C which is not integral with the body 1A. Also, the present invention can be adapted to the case 1C which only covers one end 2B of the body of the actuator 2 (i.e., only part of the non-output side) instead of covering most of the actuator.

The entire contents of Japanese Patent Application No. Tokuganhei 9-058662, filed Mar. 13, 1997, is incorporated herein by reference.

What is claimed is:

1. An apparatus for controlling a throttle valve electronically in an internal combustion engine, comprising:

a) a main body;

b) a throttle valve installed in an intake air passage of an internal combustion engine;

c) an actuator to control said throttle valve to open/close;

d) a supporting member to fasten a body of said actuator to said main body on an output side of said actuator;

e) a cover member to cover said body of said actuator and which is supported near a non-output side of said actuator by the main body, said actuator having a predetermined gap to said cover member; and f) an elastic member in said predetermined gap on said non-output side of said actuator.

2. An apparatus for controlling a throttle valve electronically in an internal combustion engine as set forth in claim 1, wherein said elastic member is formed between a cylindrical outer side of said actuator on the non-output side and inside of said cover member.

3. An apparatus for controlling a throttle valve electronically in an internal combustion engine as set forth in claim 1, wherein said elastic member is formed between a plane perpendicular to an output axis of said actuator and inside of said cover member.

4. An apparatus for controlling a throttle valve electronically in an internal combustion engine as set forth in claim 1, which further comprises a fixing member to fix said elastic member at a predetermined position inside of said cover member.

5. An apparatus for controlling a throttle valve electronically in an internal combustion engine as set forth in claim 4, wherein said elastic member is formed between a cylindrical outer side of said actuator on the non-output side and inside of said cover member, and said fixing member restricts movement of said elastic member along a cylindrical central axis of said non-output side of said actuator.

6. An apparatus for controlling a throttle valve electronically in an internal combustion engine as set forth in claim 1, wherein said elastic member is an o-ring.

7. An apparatus for controlling a throttle valve electronically in an internal combustion engine, comprising:

a) a main body;

b) an open/close means for adjusting flow in an intake air passage of an internal combustion engine;

c) an actuator means for controlling said open/close means;

d) a supporting means for fastening a body of said actuator means to said main body on an output side of said actuator means;

e) a cover means for covering said actuator means and which is supported near a non-output side of said actuator means by the main body, said actuator means having a predetermined gap to said cover means; and f) an elastic means in said predetermined gap on said non-output side of said actuator means.

8. An apparatus for controlling a throttle valve electronically in an internal combustion engine as set forth in claim 7, wherein said elastic means is formed between a cylindrical outer side of said actuator means on the non-output side and inside of said cover means.

9. An apparatus for controlling a throttle valve electronically in an internal combustion engine as set forth in claim 7, wherein said elastic means is formed between a plane perpendicular to a n output axis of said actuator means and inside of said cover means.

10. An apparatus for controlling a throttle valve electronically in an internal combustion engine as set forth in claim 7, which further comprises fixing means for fixing said elastic means at a predetermined position inside of said cover means.

11. An apparatus for controlling a throttle valve electronically in an internal combustion engine as set forth in claim 10, wherein said elastic means is formed between a cylindrical outer side of said actuator means on the non-output side and the inside of said cover means, and said fixing means restricts movement of said elastic means along a cylindrical central axis of said non-output side of said actuator means.

12. An apparatus for controlling a throttle valve electronically in an internal combustion engine as set forth in claim 7, wherein said elastic means is an o-ring.

* * * * *